US012790060B2

(12) United States Patent
Matsui

(10) Patent No.: US 12,790,060 B2
(45) Date of Patent: Nov. 10, 2026

(54) BAG OPENING SYSTEM AND BAG OPENING CONTAINER

(71) Applicant: FANUC CORPORATION, Yamanashi (JP)

(72) Inventor: Hiroki Matsui, Minamitsuru-gun (JP)

(73) Assignee: FANUC CORPORATION, Yamanashi (JP)

( * ) Notice: Subject to any disclaimer, the term of this patent is extended or adjusted under 35 U.S.C. 154(b) by 269 days.

(21) Appl. No.: 18/724,111

(22) PCT Filed: Mar. 16, 2022

(86) PCT No.: PCT/JP2022/012077
§ 371 (c)(1),
(2) Date: Jun. 25, 2024

(87) PCT Pub. No.: WO2023/175805
PCT Pub. Date: Sep. 21, 2023

(65) Prior Publication Data

US 2025/0058921 A1 Feb. 20, 2025

(51) Int. Cl.
*B65B 69/00* (2006.01)

(52) U.S. Cl.
CPC ..... *B65B 69/0008* (2013.01); *B65B 69/005* (2013.01)

(58) Field of Classification Search
CPC ..... B65B 69/0008; B65B 69/0033; B65B 69/0041; B65B 69/005; B65B 69/0075
See application file for complete search history.

(56) References Cited

U.S. PATENT DOCUMENTS 3,680,725 A * 8/1972 Poulton ..... B65B 69/0008 414/415
4,527,716 A * 7/1985 Haas ..... B65G 65/40 414/412

(Continued)

FOREIGN PATENT DOCUMENTS

CN 106005635 A 10/2016
CN 110861812 A * 3/2020 ..... A61J 1/10

(Continued)

OTHER PUBLICATIONS

International Search Report issued in PCT/JP2022/012077; mailed Jun. 7, 2022.

*Primary Examiner* — Gregory W Adams
(74) *Attorney, Agent, or Firm* — Studebaker Brackett PLLC

(57) ABSTRACT

A bag opening system according to the present disclosure has high tolerance for the shape of a bag and comprises: a bag opening container which is formed to have an open upper portion so as to be capable of receiving a bag used to store powdered or granulated material and which has, on at least one of a side face and a bottom face thereof, a discharge window through which the powdered or granulated material can pass but the bag cannot; a cutting mechanism that inserts, into the discharge window, a bag cutter for cutting the bag, thereby forming, in the bag, a discharge opening through which the powdered or granulated material can flow out; and a swing mechanism that swings the bag opening container to cause the powdered or granulated material to flow out from the discharge opening and through the discharge window to the outside of the bag opening container.

4 Claims, 4 Drawing Sheets

(56) References Cited

U.S. PATENT DOCUMENTS

| | | | | | |
|---|---|---|---|---|---|
| 5,277,014 | A * | 1/1994 | White | B65B 69/0008 | 414/412 |
| 5,638,988 | A * | 6/1997 | Rogers | B65D 5/445 | 141/330 |
| 5,813,192 | A * | 9/1998 | White | B65B 69/0008 | 53/381.2 |
| 2012/0048080 | A1* | 3/2012 | Zardini | B65B 69/0033 | 83/13 |
| 2018/0361047 | A1* | 12/2018 | Gillespie | A61M 1/1666 | |

FOREIGN PATENT DOCUMENTS

| | | | |
|---|---|---|---|
| CN | 111516951 | A | 8/2020 |
| JP | H06-144430 | A | 5/1994 |
| JP | H07-165223 | A | 6/1995 |
| JP | 2005-047555 | A | 2/2005 |
| JP | 2008-001431 | A | 1/2008 |
| JP | 2010-243388 | A | 10/2010 |
| JP | 2020-524555 | A | 8/2020 |
| JP | 2021-130493 | A | 9/2021 |

* cited by examiner

BAG OPENING SYSTEM AND BAG OPENING CONTAINER

TECHNICAL FIELD

The present invention relates to a bag opening system and a bag opening container.

BACKGROUND ART

Various facilities require bag opening operations to feed bagged powdery and granular materials, etc. into predetermined processing facilities. To automate such bag opening operations, there has been proposed a bag opening system in which a robot holds a bag, an upper portion of the bag held by the robot is cut, the bag is inverted by the robot, and the contents are fed into a predetermined processing facility (for example, see Patent Document 1).

CITATION LIST

Patent Document

Patent Document 1: Japanese Unexamined Patent Application, Publication No. H7-165223

DISCLOSURE OF THE INVENTION

Problems to be Solved by the Invention

Even for the same raw material, the shape of the bag may differ depending on the raw material manufacturer or the like. In addition, in some cases, it is required to sequentially open a plurality of types of raw materials. In conventional systems, since the head is designed for each shape of the bag, if bags having different shapes coexist, there is a possibility that the work cannot be performed. Therefore, a bag opening system having a large tolerance for the shape of the bag is desired.

Means for Solving the Problems

A bag opening system according to one aspect of the present disclosure includes a bag opening container including an open upper portion capable of receiving a bag containing powdered or granulated material, and a discharge window, on at least one of a side surface or a bottom surface, through which the powdered or granulated material can pass and through which the bag cannot pass; a cutting mechanism configured to insert a bag cutter for cutting the bag into the discharge window to form, in the bag, a discharge port through which the powdered or granulated material can flow out; and a shaking mechanism configured to shake the bag opening container to cause the powdered or granulated material to flow out from the discharge port to an outside of the bag opening container through the discharge window.

Effects of the Invention

According to the present disclosure, it is possible to provide a bag opening system having a large tolerance for the shape of a bag.

PREFERRED MODE FOR CARRYING OUT THE INVENTION

Figure 1:
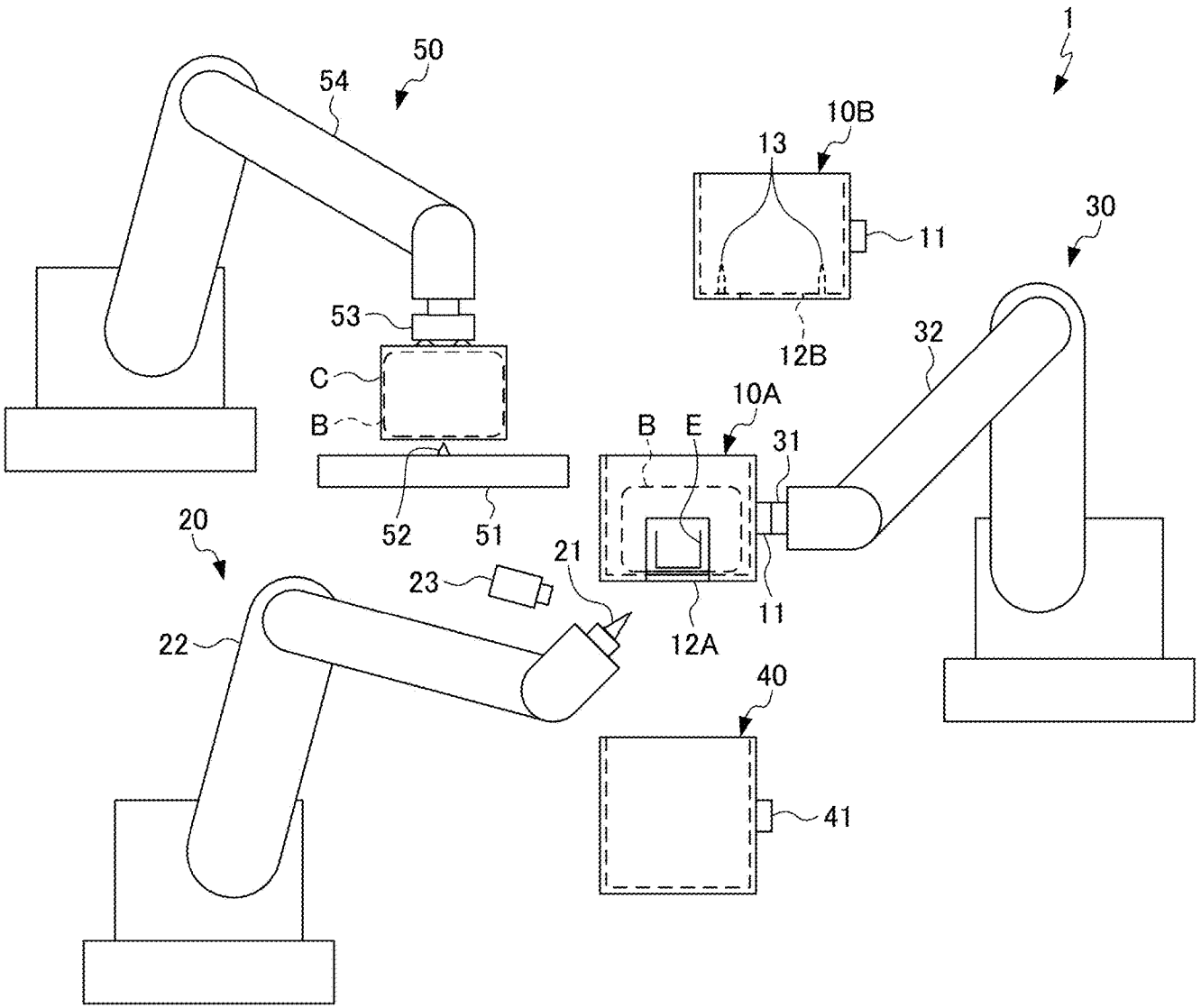
FIG. 1 is a schematic diagram showing the configuration of a bag opening system according to a first embodiment of the present disclosure.

Hereinafter, an embodiment of the present disclosure will be described with reference to the drawings. FIG. 1 is a schematic diagram showing the configuration of a bag opening system 1 according to a first embodiment of the present disclosure.

The bag opening system 1 is a system for removing powdered or granulated material from a bag B containing the powdered or granulated material. In the present embodiment, the bag B can be provided in a state of being housed in a box C (for example, an A type cardboard box) having flaps which are fastened by tape to form a bottom. The bag opening system 1 of the present embodiment can be configured such that the powdered or granulated material removed from the bag B is finally fed into a predetermined feeding port (not shown) of, for example, a tank that stores the powdered or granulated material, a hopper of equipment that processes the powdered or granulated material, or the like.

Figure 2:
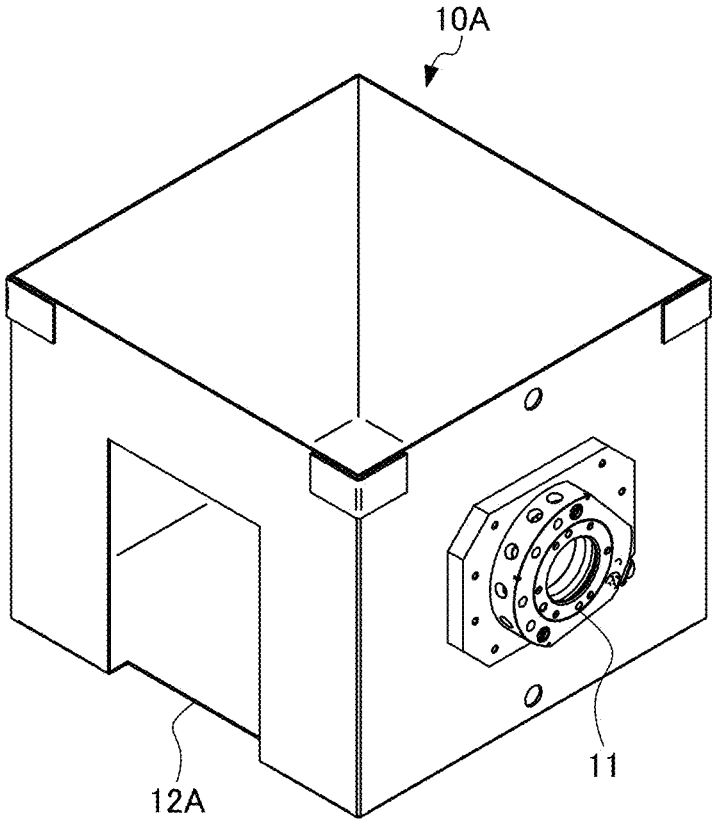
FIG. 2 is a perspective view showing a bag opening container of the bag opening system of FIG. 1.
Figure 3:
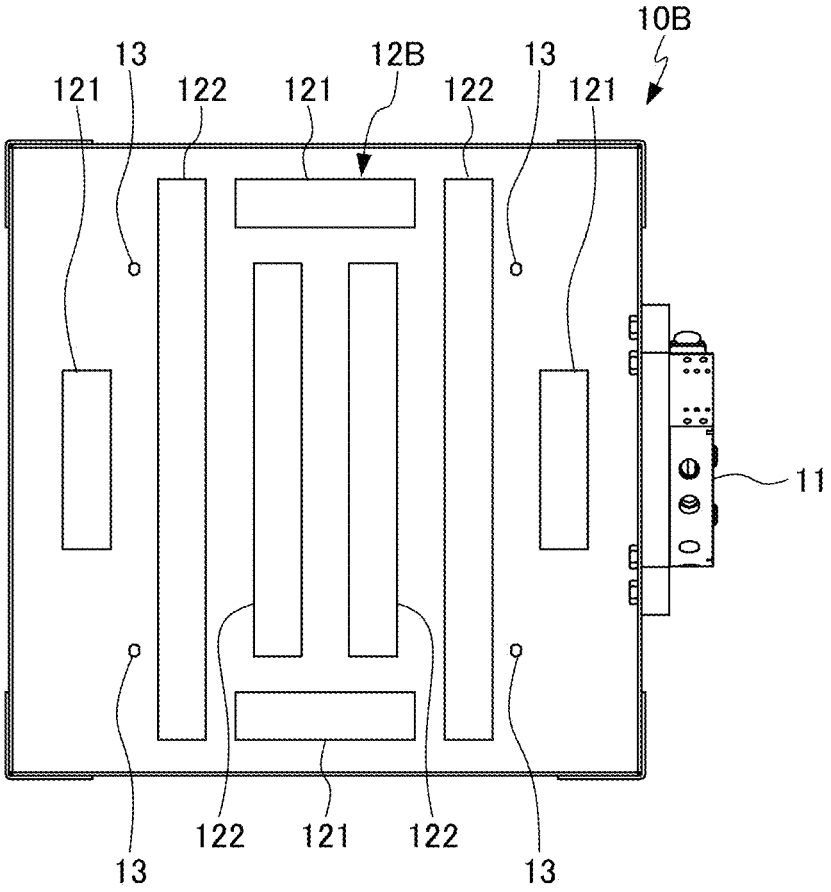
FIG. 3 is a plan view showing a bag opening container different from that of FIG. 2 of the bag opening system of FIG. 1.

The bag opening system 1 includes a plurality of bag opening containers (a first bag opening container 10A shown in detail in FIG. 2 and a second bag opening container 10B shown in detail in FIG. 3) each formed to be capable of receiving a bag B containing powdered or granulated material, a cutting mechanism 20 that forms, in the bag B held in the bag opening container 10A or 10B, a discharge port E through which the powdered or granulated material can flow out, a shaking mechanism 30 that shakes the bag opening container 10A or 10B, an intermediate container 40 that receives the powdered or granulated material flowing out from the bag B held in the bag opening container 10A or 10B, and an insertion mechanism 50 that inserts the bag B into the bag opening container 10A or 10B.

The bag opening containers 10A and 10B are each used to hold the bag B, open the bag B, and discharge the contained powdered or granulated material. Each of the bag opening containers 10A and 10B according to the present embodiment is an embodiment of the bag opening container according to the present disclosure.

Each of the bag opening containers 10A and 10B has one rectangular bottom plate and four rectangular side plates, and is formed in a box shape having an open upper portion and capable of receiving the bag B. The length and width of each of the bag opening containers 10A and 10B can be 1.0 times or more and 1.5 times or less of the length and width (average value in a state of being inserted into each of the bag opening containers 10A and 10B) of the bag B to be received. Each of the bag opening containers 10A and 10B is provided with a connector 11 for attaching to and detaching from the shaking mechanism 30 on one side surface (outer side of a side plate), and includes a discharge window 12A or 12B which is formed so as to open on at least one of a side surface or the bottom surface in order to discharge the powdered or granulated material and through which the powdered or granulated material can pass and through which the bag cannot pass. Since the bag opening system 1 discharges the powdered or granulated material from the discharge window 12A or 12B of the bag opening container 10A or 10B having an open upper portion, the tolerance for the shape of the bag B is large.

The first bag opening container 10A is used in a case where the bag B is formed of a material having relatively high rigidity such as kraft paper, aluminum vapor deposition, or a laminate sheet and can maintain the outline shape even after the powdered or granulated material is discharged. On the other hand, the second bag opening container 10B is used when the bag B is formed of a material having relatively low rigidity, such as a vinyl film, which can be easily deformed when the powdered or granulated material is discharged.

The first bag opening container 10A includes a rectangular discharge window 12A mainly at a central portion in the lateral direction of one side surface so as to leave an upper portion of the side plate. To facilitate the discharge of the powdered or granulated material, it is preferable that the discharge window 12A is formed to an end portion of the bottom plate so that at least a part of the discharge window 12A opens on the bottom surface of the first bag opening container 10A. The height of the discharge window 12A of the first bag opening container 10A is preferably ½ or more and 3/2 or less, and more preferably ⅔ or more and 1/1 or less of the thickness of the bag B to be received, in order to facilitate discharge of the powdered or granulated material. The width of the discharge window 12A of the first bag opening container 10A is preferably ¼ or more and ⅔ or less, and more preferably ⅓ or more and ½ or less of the length of the bag B to be received, in order to efficiently discharge the powdered or granulated material while holding the bag B in the first bag opening container 10A.

The second bag opening container 10B further includes a plurality of pins 13 arranged upward on the bottom surface so as to pierce the bag B when the bag B is inserted from above. The pins 13 hold the bag B inside the second bag opening container 10B so that the bag B does not fall out through a discharge window 12B. The number of the pins 13 may be, for example, four. The distance of the pin 13 in the width direction and the depth direction of the second bag opening container 10B from the side plate of the second bag opening container 10B is preferably ⅕ or more and ⅓ or less of the length of the second bag opening container 10B in each direction so that the pin 13 can reliably pierce the bag B and the shape of the bag B can be maintained as much as possible. The length of the pin 13 is preferably ⅕ or more and ⅔ or less of the thickness of the bag B so as not to penetrate the top surface of the bag B while reliably penetrating the bottom surface of the bag B.

A plurality of discharge windows 12B are formed on the bottom surface of the second bag opening container 10B. The plurality of discharge windows 12B preferably include four side discharge windows 121 each formed to extend along at least a central portion of each of four sides of the bottom plate, and one or more central discharge windows 122 formed between the side discharge windows 121. Each of the discharge windows 12B of the second bag opening container 10B is preferably formed in a slit shape so as to easily hold the bag B. The width of each of the discharge windows 12B of the second bag opening container 10B may be 30 mm or more and 50 mm or less.

When the bag B is of a gusset type, that is, when the bag B has a gusset, in particular, when sheets are stacked on the bottom portion to form the gusset, the side discharge windows 121 are formed in order to efficiently discharge the powdered or granulated material that has entered the triangular space formed between the sheets. The side discharge windows 121 are respectively formed along the four sides of the bottom plate in order to discharge the powdered or granulated material regardless of the orientation of the bag B inserted into the second bag opening container 10B, particularly when the width of the front surface of the bag B is substantially equal to the length (depth) of the gusset.

The central discharge window 122, alone or in combination with the side discharge window 121, is preferably formed to substantially traverse the second bag opening container 10B in at least one direction. The opening ratio of the discharge window 12B in the transverse direction (presence ratio of the discharge window 12B on the imaginary line traversing the second bag opening container 10B) is preferably 80% or more. Accordingly, by inclining the second bag opening container 10B in a direction perpendicular to the transverse direction of the discharge window 12B, the powdered or granulated material can be easily discharged through the discharge window 12B.

The cutting mechanism 20 includes a bag cutter 21 that is inserted into the bag opening container 10A or 10B through the discharge window 12A or 12B and cuts the bag B. The cutting mechanism 20 may include a holding structure that holds the bag cutter 21 immovably, or a simple holding mechanism that disposes the bag cutter 21 above the intermediate container 40 at the time of cutting the bag B and retracts the bag cutter 21 at the time of discharging the powdered or granulated material, for example, but preferably includes a cutting robot 22 that can hold the bag cutter 21 and move it freely. As the cutting robot 22, typically, a vertical articulated robot may be used, but other types of robots may be used. The cutting mechanism 20 preferably includes a cutter confirmation unit 23 that detects whether the bag cutter 21 has chipped, that is, whether there is the possibility that fragments of the bag cutter 21 are included in the powdered or granulated material.

As the bag cutter 21, it is preferable to use an ultrasonic cutter that can reliably cut the bag B and is less prone to chipping. The cutting robot 22 preferably moves the bag cutter 21 so as to form a horizontal cutting line extending in the horizontal direction and a pair of vertical cutting lines extending upward from both ends of the horizontal cutting line. As described above, the flap-shaped portion defined by the three cutting lines is pushed open by the pressure of the powdered or granulated material, and the discharge port E from which the powdered or granulated material is easily discharged is formed. The bag B is preferably cut by moving the bag cutter 21 from the bottom upward as in the order of the above description. Accordingly, when the powdered or granulated material flows out from the bag B immediately after the bag B is cut, it is possible to suppress the flowing-out powdered or granulated material from coming into contact with the cutting mechanism 20 and adhering to or scattering. It is preferable that the cutting mechanism 20 causes the bag cutter 21 to approach in a horizontal direction or an inclined direction with respect to the bag so that the flowing-out powdered or granulated material is less likely to come into contact with the cutting mechanism 20 and adhere to or scatter. The cutter confirmation unit 23 can be a system that captures an image of the bag cutter 21 and confirms the presence or absence of chipping by image processing.

The cutting robot 22 can also be used to remove the empty bag B from the bag opening container 10A or 10B after the discharge of the powdered or granulated material is completed. In this case, the bag B may be further shaken by the cutting robot 22 to discharge the remaining powdered or granulated material.

The shaking mechanism 30 shakes the bag opening container 10A or 10B to cause the powdered or granulated material to flow out from the discharge port E formed in the bag B to the outside of the bag opening container 10A or 10B through the discharge window 12A or 12B. It is preferable that the shaking mechanism 30 shakes the bag opening container 10A or 10B in a plurality of directions in order to facilitate the discharge of the powdered or granulated material from the discharge window 12A or 12B. The shaking mechanism 30 may invert the bag opening container 10A or 10B in order to discharge the remaining powdered or granulated material after the empty bag B is removed from the bag opening container 10A or 10B.

When the cutting mechanism 20 and the insertion mechanism 50 operate, the shaking mechanism 30 desirably holds the bag opening container 10A or 10B in a position and an orientation optimal for the operations of the cutting mechanism 20 and the insertion mechanism 50. In particular, when the discharge window 12A opened on the side surface of the first bag opening container 10A is used, the shaking mechanism 30 preferably holds the first bag opening container 10A in an inclined state so that the discharge window 12A is located relatively downward. Accordingly, since the bag B moves to the discharge window 12A side in the first bag opening container 10A by its own weight, the bag cutter 21 is easily approached, and the discharge port E is easily formed.

The shaking mechanism 30 may shake the bag opening container 10A or 10B at a position where the powdered or granulated material can be directly fed into a predetermined feeding port, but it is preferable to once feed the powdered or granulated material flowing out into the intermediate container by shaking the bag opening container 10A or 10B above the intermediate container 40. As a result, when chipping of the bag cutter 21 or the like occurs, only the powdered or granulated material fed into the intermediate container 40 may be rejected, so that the loss of the powdered or granulated material can be minimized.

It is preferable that the shaking mechanism 30 includes a shaking robot 32 including an engaging part 31 that engages with the connector 11 of the bag opening container 10A or 10B at the distal end thereof. As the shaking robot 32, typically, a vertical articulated robot can be used, but other types of robots may be used. By using the shaking robot 32, it is possible to easily realize the optimal bag opening container 10A or 10B and shaking operation thereof according to the type of the bag B to be opened, and thus the versatility of the bag opening system 1 can be improved.

The shaking robot 32 preferably also serves as a handling mechanism for handling the intermediate container 40. That is, the shaking robot 32 is preferably configured to be capable of selectively holding one of the bag opening container 10A or 10B and the intermediate container 40. The shaking robot 32 not only shakes the bag opening container 10A or 10B to discharge the powdered or granulated material, but also performs processing such as feeding of the powdered or granulated material in the intermediate container 40 to a predetermined feeding port and rejection of the powdered or granulated material in the intermediate container 40 when chipping of the bag cutter 21 occurs, thereby reducing the equipment cost of the bag opening system 1 and reducing the installation space. On the other hand, the shaking robot 32 may also be used as the cutting robot 22 of the cutting mechanism 20, but in order to shorten the cycle time, the shaking robot 32 is preferably provided separately from the cutting robot 22.

The intermediate container 40 temporarily stores the powdered or granulated material discharged from the bag opening container 10A or 10B. This makes it possible to minimize rejection of the powdered or granulated material when chipping of the bag cutter 21 occurs. As described above, it is preferable that the intermediate container 40 can be handled by the shaking robot 32 of the shaking mechanism 30, that is, has a connector 41 similar to the connector 11 of the bag opening container 10A or 10B. The bag opening system 1 may further include a handling mechanism that handles the intermediate container 40 or a transport mechanism that transports the powdered or granulated material in the intermediate container 40.

The insertion mechanism 50 inserts the bag B into the bag opening container 10A or 10B from above. The insertion mechanism 50 of the present embodiment includes a table 51 that provides a placement surface on which a box C containing the bag B can be placed, a tape cutter 52 that protrudes from the placement surface of the table 51 to cut the tape attached to the bottom surface of the box C, a holding head 53 that holds the upper portion of the box C, and an insertion robot 54 that moves the holding head 53.

As will be described later, the table 51 can prevent the flaps of the box C from being opened by holding the flaps of the box C from the lower side by the placement surface even in a state in which the tape for fastening the flaps of the box C is cut and the flaps can be opened. The placement surface can be coated with a material capable of reducing friction, such as PTFE, to facilitate movement of the box C, i.e. sliding of the box C, while preventing opening of the flaps. The table 51 may include a sensor for checking the positions of the flaps and the tape of the box C.

The tape cutter 52 protrudes from the placement surface of the table 51, and cuts the tape that fastens the flaps constituting the bottom of the box C by the box C moving thereon without moving itself. As the tape cutter 52, an ultrasonic cutter is preferably used as is the case with the bag cutter 21. In addition, the tape cutter 52 is preferably provided so as to be retractable below the placement surface so that the table 51 can be used for other processes.

The holding head 53 is preferably configured to be able to directly hold the bag B when the bag B is provided without being housed in the box C. Specifically, the holding head 53 can be configured to hold the upper surface of the box C or the bag B by suction with a suction pad. The holding head 53 may include a sensor or the like for recognizing the position of the bag B or the box C.

The insertion robot 54 horizontally moves the box C held by the holding head 53 in a state of being placed on the table 51, so that the tape cutter 52 cuts the tape that fastens the flaps forming the bottom of the box C. Further, the insertion robot 54 horizontally moves the box C to a position above the bag opening container 10A or 10B, which are positioned adjacent to the table 51 and below the placement surface. Accordingly, since the support by the support surface is eliminated, the flaps forming the bottom of the box C are opened by gravity, and the bag B in the box C is dropped into the bag opening container 10A or 10B. It is preferable that the operation of the insertion robot 54 is corrected based on the detection result of the sensor provided in the table 51 or the like so that the tape cutter 52 passes through the cutting position where the flaps can be reliably opened according to the positions of the flaps confirmed by the sensor of the table 51. As the insertion robot 54, typically, a vertical articulated robot can be used, but other types of robots may also be used.

Figure 4:
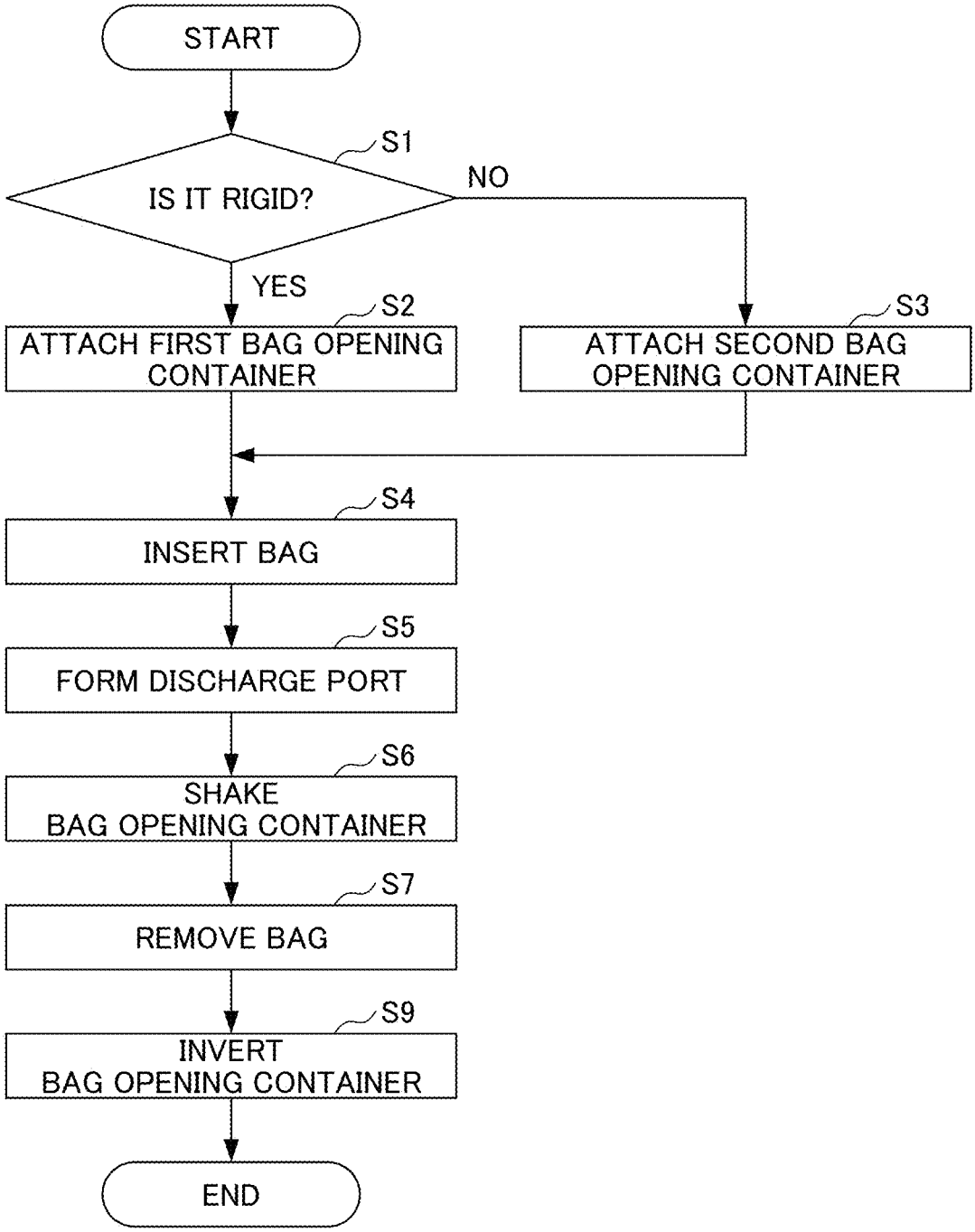
FIG. 4 is a flowchart showing the procedure of bag opening processing by the bag opening system of FIG. 1.

Although it is obvious from the above description, the procedure of bag opening processing (removal of the powdered or granulated material) by the bag opening system 1 according to the present embodiment will be described again. FIG. 4 is a flowchart showing the procedure of bag opening processing by the bag opening system 1.

The bag opening processing by the bag opening system 1 includes a step of checking whether the bag B has rigidity (S1: bag checking step), a step of attaching the first bag opening container 10A to the shaking mechanism 30 (shaking robot 32) when the bag B has rigidity (S2: first bag opening container attaching step), a step of attaching the second bag opening container 10B to the shaking mechanism 30 when the bag B does not have rigidity (S3: second bag opening container attaching step), a step of inserting the bag B into the bag opening container 10A or 10B (S4: bag inserting step), a step of cutting the bag B with the cutting mechanism 20 to form the discharge port E (S5: discharge port forming step), a step of causing the powdered or granulated material to flow out from the discharge port E to the outside of the bag opening container 10A or 10B through the discharge window 12A or 12B by shaking the bag opening container 10A or 10B held by the shaking mechanism 30 in a shaking pattern according to the type thereof (S6: bag opening container shaking step), a step of removing the bag from the bag opening container 10A or 10B with the cutting mechanism 20 (S7: bag removing step), and a step of discharging the remaining powdered or granulated material by inverting the bag opening container 10A or 10B (S8: bag opening container inverting step).

The bag opening system 1, in an unmanned manner, inserts the bag B into the bag opening container 10A or 10B, forms the discharge port E in the bag B, and discharges the powdered or granulated material. In the bag opening system 1, since the bag B is inserted into the bag opening container 10A or 10B in which the upper portion is opened and the discharge window 12A or 12B is formed on the side surface or the bottom surface, the tolerance for the shape of the bag B is large, and the powdered or granulated material can be removed from different bags B.

In the bag opening system 1, when the bag B is held with the pins 13, since the pins 13 pierce the bag B by inserting the bag B from above, the powdered or granulated material can be easily and reliably discharged from the bag B that has smaller rigidity. Further, the bag opening system 1 uses the second bag opening container 10B having the four side discharge windows 121 each formed to extend along at least the central portion of each of the four sides of the bottom plate, and the one or more central discharge windows 122 formed between the side discharge windows 121, and thus, the powdered or granulated material can be reliably discharged from the gusset-type bag B.

Although the embodiment of the present disclosure has been described above, the present invention is not limited to the above-described embodiment. The effects described in the above-described embodiment are merely listed as advantageous effects generated from the present invention, and the effects of the present invention are not limited to those described in the above-described embodiment.

The bag opening system according to the present disclosure may use a single bag opening container, or may use three or more bag opening containers having different shapes according to the bag. In the bag opening system according to the present disclosure, the intermediate container and the insertion mechanism are not essential components.

EXPLANATION OF REFERENCE NUMERALS

1 bag opening system
10A, 10B bag opening container
11 connector
12 shaking robot
12A, 12B discharge window
121 side discharge window
122 central discharge window
13 pin
20 cutting mechanism
21 bag cutter
22 cutting robot
23 cutter confirmation unit
30 shaking mechanism
31 engaging part
32 shaking robot
40 intermediate container
41 connector
50 insertion mechanism
51 table
52 tape cutter
53 holding head
54 insertion robot
B bag
C box
E discharge port

The invention claimed is:

1. A bag opening system, comprising:

a bag opening container that has an open upper portion capable of receiving a bag containing powdered or granulated material, and a discharge window, on at least one of a side surface or a bottom surface, through which the powdered or granulated material can pass and through which the bag cannot pass;

a cutting mechanism configured to insert a bag cutter for cutting the bag into the discharge window to form, in the bag, a discharge port through which the powdered or granulated material can flow out;

a shaking mechanism configured to shake the bag opening container to cause the powdered or granulated material to flow out from the discharge port to an outside of the bag opening container through the discharge window; and an intermediate container configured to receive the powdered or granulated material discharged by the shaking mechanism, wherein the shaking mechanism has a shaking robot capable of selectively holding one of the bag opening container and the intermediate container, and the shaking robot holds and moves the intermediate container to feed the powdered or granulated material in the intermediate container to a predetermined feeding port.

2. The bag opening system according to claim 1, wherein the bag opening container has a plurality of pins arranged upward on a bottom surface thereof so as to pierce the bag when the bag is inserted from above.

3. The bag opening system according to claim 1, wherein the bag opening container has one rectangular bottom plate and four rectangular side plates, and the discharge window includes four side discharge windows each formed to extend along at least a central portion of each of the four sides of the bottom plate, and one or more central discharge windows formed between the side discharge windows.

4. The bag opening system according to claim 1, further comprising an insertion mechanism configured to insert the bag into the bag opening container, wherein the bag can be provided in a state of being housed in a box having a flap which is fastened by tape to form a bottom, the insertion mechanism has a table that provides a placement surface on which the box can be placed, a tape cutter that protrudes from the placement surface to cut the tape, a holding head configured to hold an upper portion of the box, and an insertion robot configured to move the holding head, and the insertion robot horizontally moves the box in a state of being placed on the table to cut the tape with the tape cutter, horizontally moves the box to an outside of the table to open the flap by gravity, and drops the bag into the bag opening container.

* * * * *